US008771802B1

(12) United States Patent
Hays et al.

(10) Patent No.: US 8,771,802 B1
(45) Date of Patent: Jul. 8, 2014

(54) DEVICE AND MATERIALS FABRICATION AND PATTERNING VIA SHAPED SLOT ELECTRODE CONTROL OF DIRECT ELECTROSTATIC POWDER DEPOSITION

(71) Applicant: Xactiv Inc., Fairport, NY (US)

(72) Inventors: Dan A. Hays, Venice, FL (US); James Mason, Victor, NY (US); Peter J. Mason, Fairport, NY (US)

(73) Assignee: Xactiv, Inc., Fairport, NY (US)

( * ) Notice: Subject to any disclaimer, the term of this patent is extended or adjusted under 35 U.S.C. 154(b) by 0 days.

(21) Appl. No.: 13/866,100

(22) Filed: Apr. 19, 2013

Related U.S. Application Data

(60) Provisional application No. 61/687,191, filed on Apr. 20, 2012.

(51) Int. Cl.
*B05D 1/06* (2006.01)
*B05C 5/02* (2006.01)
*B05D 1/00* (2006.01)

(52) U.S. Cl.
CPC ..... *B05D 1/007* (2013.01); *B05C 5/0254* (2013.01)
USPC ..... 427/477; 427/458; 427/475

(58) Field of Classification Search
USPC ..... 427/458, 475, 477
See application file for complete search history.

(56) References Cited

U.S. PATENT DOCUMENTS 3,680,779 A * 8/1972 Reilly ..... 239/3
3,689,935 A 9/1972 Pressman
4,491,855 A 1/1985 Fujii et al.
4,546,060 A 10/1985 Miskinis et al.
4,568,955 A 2/1986 Hosoya et al.
4,743,926 A 5/1988 Schmidlin et al.
4,863,538 A 9/1989 Deckard
5,036,341 A 7/1991 Larsson
5,038,159 A 8/1991 Schmidlin et al.
5,121,144 A 6/1992 Larson et al.
5,204,055 A 4/1993 Sachs et al.
5,409,791 A 4/1995 Kaukeinen et al.
5,812,160 A 9/1998 Wda et al.
6,206,672 B1 3/2001 Grenda
6,561,628 B1 * 5/2003 Camis et al. ..... 347/55
2005/0287306 A1 * 12/2005 Hays et al. ..... 427/458

OTHER PUBLICATIONS

"TonerJet Tandem Color has Reached Prototype Stage," Sandberg, conference proceedings of IS&T, NIP14: 1998 International Conference on Digital Printing Technologies pp. 180-183; EFS file name 20131112_13-866100_IDS_NPL_cite1.pdf.

(Continued)

*Primary Examiner* — Frederick Parker
(74) *Attorney, Agent, or Firm* — Patent Innovations LLC; John M. Hammond

(57) ABSTRACT

An object fabricating apparatus is comprised of at least one charged powder cloud generating system, at least one electrode proximate to the powder cloud generating system and comprising at least one shaped slot, and a voltage supply in communication with each electrode to electrostatically modulate the flow of charged powder to a conductive substrate electrically biased to provide an electrostatic attraction of the charged powder to the substrate. An object fabricating method is also disclosed that uses the object fabricating apparatus.

22 Claims, 7 Drawing Sheets

(56) References Cited

OTHER PUBLICATIONS

"Dot Formation by Toner Beam from Toner Cloud" Hoshino et al., conference proceedings of IS&T, NIP15: 1999 International Conference on Digital Printing Technologies, pp. 598-600; EFS file name 20131112__13-866100__IDS__NPL__cite2.pdf.

"Dot Formation Conditions from the Conductive Toner Cloud by Aperture Electrodes," Zhou et al., conference proceedings of IS&T, NIP21: 2005 International Conference on Digital Printing Technologies, pp. 610-613; EFS file name 20131112__13-866100__IDS__NPL__cite3.pdf.

"Characterization of Toner Adhesion to Carrier: A Phenomenological Model," Maher, conference proceedings of IS&T, NIP10: 1994 International Conference on Digital Printing Technologies, pp. 156-159; EFS file name 20131112__13-866100__IDS__NPL__cite4.pdf.

* cited by examiner

DEVICE AND MATERIALS FABRICATION AND PATTERNING VIA SHAPED SLOT ELECTRODE CONTROL OF DIRECT ELECTROSTATIC POWDER DEPOSITION

CROSS-REFERENCE TO RELATED PATENT APPLICATIONS

This application claims priority from U.S. Provisional Patent Application No. 61/687,191 filed Apr. 20, 2012, the disclosure of which is incorporated herein by reference.

BACKGROUND

1. Technical Field

Devices for fabrication of three-dimensional objects from powder starting materials.

2. Description of Related Art

Various methods have been proposed to produce information containing documents (text and graphics) through the direct deposition of charged powder onto a substrate such as paper. The direct powder deposition methods enable a simpler process than those generally used in printers that use electrographic technologies. Direct powder deposition methods for producing documents typically require a set of 100 to 600 staggered apertures per inch for pixel level deposition of the powder. Direct powder deposition printing systems have not been commercially successful to date due in large part to inadequate image quality.

Among the relevant patents which disclose direct powder deposition printing of documents are U.S. Pat. No. 3,689,935 of Pressman et al., U.S. Pat. No. 4,491,855 of Fujii et al., U.S. Pat. No. 4,568,955 of Hosoya et al., U.S. Pat. No. 4,743,926 of Schmidlin et al., U.S. Pat. No. 5,038,159 of Schmidlin, et al., the disclosures of which are incorporated herein by reference. In general, these patents disclose controlling the deposition of powder by an aperture electrode structure positioned between a charged powder (toner) source and a print receiving medium.

A number of other similar patents disclose controlling the electric field around each aperture with an electrode structure that has only the control electrode on an insulating support layer in close proximity to the toner source. Among the relevant patents which disclose related teachings are U.S. Pat. No. 5,036,341 of Larsson, U.S. Pat. No. 5,121,144 of Larson et al., and U.S. Pat. No. 5,812,160 of Wada et al., the disclosures of which are incorporated herein by reference.

Additionally, certain publications have disclosed summaries and/or advances in direct printing technology, including "TonerJet Tandem Color has Reached Prototype Stage" of Sandberg in the conference proceedings of the Society for Imaging Science and Technology (IS&T), *NIP*14: 1998 *International Conference on Digital Printing Technologies*, pp. 180-183; "Dot Formation by Toner Beam from Toner Cloud" of Hoshino et al. in the conference proceedings of IS&T, *NIP*15: 1999 *International Conference on Digital Printing Technologies*, pp. 598-600; and "Dot Formation Conditions from the Conductive Toner Cloud by Aperture Electrodes" of Zhou et al. in the conference proceedings of IS&T, NIP21: 2005 *International Conference on Digital Printing Technologies*, pp. 610-613.

In all of the above cited patents and publications, the general intent of the literature is to disclose various concepts for pixel level control of direct powder deposition onto an information carrier medium such as paper. The concepts require a source of toner (charged particles) and a control electrode structure with apertures in close proximity to the toner source.

The spacing between the toner source and control electrode structure is a critical parameter that needs to be well-controlled to achieve high image quality. To obtain a well-controlled spacing in the gap between the toner source and control electrode, single component (toner only) development systems and their variants have been used for direct electrostatic deposition printers.

Two-component magnetic brush development systems (i.e., those that have a mixture of toner and magnetic carrier beads that triboelectrically charge the toner) have been widely used in electrophotography for in-contact development of electrostatic latent images formed by either light exposure of charged photoreceptors or gaseous ion controlled deposition onto an electroreceptor. For full-color electrophotographic systems that accumulate the color separations on the photoreceptor through a multiple photoreceptor recharge, expose and develop (READ) process, the development system must be non-interacting to prevent the scavenging and disturbance of previously deposited toner images. Various out-of-contact magnetic brush development systems and materials have been proposed to enable READ full color systems, but have not been commercially adopted due to the difficulties in controlling and maintaining the magnetic brush height. It is also for this reason that out-of-contact magnetic brush development systems have not been proposed for use in direct electrostatic deposition printers.

The carrier beads used in two-component magnetic brush development systems can be made from either soft magnetic or permanently magnetized materials. For soft magnetic carrier beads, the beads can be magnetized by a magnetic field but become essentially unmagnetized in the absence of a magnetic field. The magnetic brush development systems that use such two-component developer mixtures typically have stationary magnets inside a rotating sleeve that provide transport of the developer mixture to the development zone. For developer mixtures that use permanently magnetized carrier beads, the bead materials are selected to become permanently magnetized when subjected to a high magnetic field during a manufacturing process. When two-component developer mixtures with the permanently magnetized carrier beads are used in a magnetic brush development system, rotating magnets inside a stationary or rotating cylinder cause the transport of developer to the development zone. The rotating magnets acting on the permanently magnetized carrier beads causes additional mechanical agitation of the developer mixture that results in the release of some air borne toner.

Among the relevant patents which disclose the use of permanently magnetized materials in magnetic development systems are U.S. Pat. No. 4,546,060 issued to Miskinis et al., and U.S. Pat. No. 5,409,791 of Kaukeinen, et al., the disclosures of which are incorporated herein by reference. Additionally, the publication "Characterization of Toner Adhesion to Carrier: A Phenomenological Model" of Maher in the conference proceedings of IS&T, NIP10: 1994 International Conference on Digital Printing Technologies, pp. 156-159, discloses a method for measuring the charge-to-mass ratio of toner mixed with permanently magnetic carrier beads.

The patents and literature cited above describe a wide variety of digital printing technologies for printing information via the controlled placement of charged powder at a resolution of 200 to 800 dots per inch. The high resolution is necessary for printing text and graphics. In recent years, digital printing technologies have been applied to the fabrication of various 3D objects and 2D devices such as printable electronic circuits. For the most part, ink jet printing technologies are particularly well suited for such applications. However, ink jetting printing is an inherently slow process due to the need to scan ink jet heads over the substrate. Furthermore, the materials composition of the ink sometimes has undesired consequences on the final product.

It is for these reasons that powder based methods have been used for rapid building of devices and materials with particular desired characteristics. A number of patents disclose such methods for rapidly building objects, including U.S. Pat. No. 4,863,538 of Deckard, U.S. Pat. No. 5,204,055 of Sachs et al., and U.S. Pat. No. 6,206,672 of Grenda, the disclosures of which are incorporated herein by reference.

The above disclosures notwithstanding, problems remain unsolved in the fabrication of three-dimensional objects via powder-based fabrication processes. What is needed is an apparatus and method that enable precise and rapid transport and deposition of powders in three-dimensional patterns to thereby form three-dimensional objects.

SUMMARY

In one aspect of the present disclosure, a method is provided for device and materials fabrication via patterned charged powder deposition enabled by either a shaped slot or multiple shaped slot openings in either an electrode or multiple electrodes that control the direct deposition of charged powder from one or more powder sources onto a substrate. The method may be used for adding multiple layers having different patterns in order to build up an object. The invention disclosed herein provides a simpler and more efficient method for fabricating various devices and materials. The method is compatible with a range of powder materials including polymers and ceramic materials, for example. The powder source can be provided by any of a number of methods that can generate a powder cloud.

In accordance with the present disclosure, there is also provided an apparatus for the fabrication of devices and materials using either a shaped slot or multiple shaped slot openings in either an electrode or multiple electrodes that control the direct deposition of charged powder from one or more powder sources onto a substrate. The shaped slot electrode or an array of shaped slot electrodes is positioned between a charged powder source and an electrically biased substrate. The charged powder source may be provided by a magnetic brush development system such as disclosed in U.S. Pat. No. 4,546,060 and widely used in electrophotography for powder charging and transport to a coating or deposition zone.

One suitable magnetic brush development system utilizes a mixture of the coating powder and permanently magnetized carrier beads. The powder may be either insulating or charge relaxable, and the powder deposition may be obtained on either an insulative or conductive biased substrate. In the case of an insulative substrate, a conductive electrode behind the substrate is electrically biased to attract the charged powder. The method may also be used for adding multiple layers with the same or different powders having different patterns in order to build up a shaped part. In one method, the shaped part can be formed by multiple passes with a single charged particle source. Upon each pass, either the same or different electrode structures and either the same or different powders are used in combination with the single charged particle source. For a much higher manufacturing rate, multiple charged particle deposition systems can be used in tandem to build a shaped part with different powder materials and electrode structures.

For the case of a single electrode with either a single shaped slot electrode or multiple shaped slots, the amount of powder deposition may be controlled by varying either the bias voltage on the slot electrode or the substrate bias. For multiple shaped slot electrodes, the powder deposition on the substrate may be individually controlled by varying the bias voltages on the individual electrodes.

The shaped slot electrode or array of such electrodes may be made stationary relative to either the powder source or moving substrate. In either case, variable deposition onto a substrate in the process direction may be obtained by controlling the electrical bias on the shaped slot electrode or array of such electrodes. When the shaped slot electrode or array of such electrodes are stationary relative to the moving substrate, the patterned powder deposition is according to an out-of-contact stencil or mask.

More particularly, the present invention meets the aforementioned need by providing an apparatus for fabricating an object. The invention can be illustrated by describing the fabrication of an object with a first charged powder cloud generating system containing a first charged powder, and a second charged powder cloud generating system containing a second charged powder. The electrode structures in proximity to the first and second powder cloud generating systems are comprised of one or more electrode structures that have either a single shaped slot or multiple shaped slots, and voltage supplies in communication with the electrodes. For a charged powder cloud generating system with only two electrode structures, the voltage supplies are configured to apply a bias voltage to the one electrode and a second bias voltage to the other electrode to thereby independently meter a first portion of charged powder through the first electrode structure and a second portion of charged powder through the second electrode structure.

The apparatus may be further comprised of a drive for translating the substrate to receive charged powder depositions from stationary charged powder cloud generating systems and electrode structures. In such a configuration, the shaped slots in the electrode structures have longitudinal axes perpendicular to the direction of relative motion of the substrate. The apparatus may include means for consolidating the first portion of charged powder and the second portion of charged powder on a substrate.

The apparatus may include a voltage control system that monitors the position of the substrate so that time-dependent bias voltages supplied to the different electrode structures can be timed to provide the desired powder depositions on the substrate. The bias voltage applied to each electrode structure associated with each charged powder cloud generating system is programmed to have a unique time-dependent profile that provides the desired powder deposition profile on the moving substrate.

In accordance with the invention, there is also provided a method for fabricating an object comprising the steps of causing the formation of at least one cloud of charged powder proximate to a shaped slot or multiple shaped slot openings in an electrode or multiple electrodes, the electrode or multiple electrodes disposed between the cloud and a substrate positioned to receive a portion of the charged powder; applying a first bias voltage to the shaped slot electrode to cause flow of charged powder through the shaped slot, and applying a second bias voltage to the conductive substrate to cause attraction of charged first powder onto the substrate to form a first part of the object. The first and/or second bias voltages may be variable, and may vary as a function of time. In embodiments employing multiple shaped slot openings in an electrode or multiple electrodes, the method may further comprise applying different time-dependent bias voltages to the different shaped slots of electrodes to cause flow of the same or different charged powder onto the substrate to form additional parts of the object.

The method may further comprise consolidating the different portions of charged powder on the substrate to form the different parts of the object. The method may further comprise moving the substrate relative to the electrode structures. The substrate may be moved past the single or multiple electrode structures at least two times, thereby depositing additional powder layers with the same charged powder source and same single or multiple electrode structures. The method may further comprise independently varying the bias voltages of multiple electrode structures.

The method may include causing the formation of a first cloud of first charged powder proximate to a first shaped slot electrode or first multiple shaped slot electrodes and applying first bias voltage to the first shaped slot or first bias voltages to first multiple shaped slot electrodes to cause flow of a first portion of the first charged powder through the electrodes and onto the substrate; and causing the formation of a second cloud of second charged powder proximate to a second shaped slot electrode or second multiple shaped slot electrodes and applying second bias voltage to the second shaped slot or second bias voltages to second multiple shaped slot electrodes to cause flow of a second portion of the first charged powder through the electrodes and onto the substrate.

BRIEF DESCRIPTION OF THE DRAWINGS

The present disclosure will be provided with reference to the following drawings, in which like numerals refer to like elements, and in which.

Figure 1:
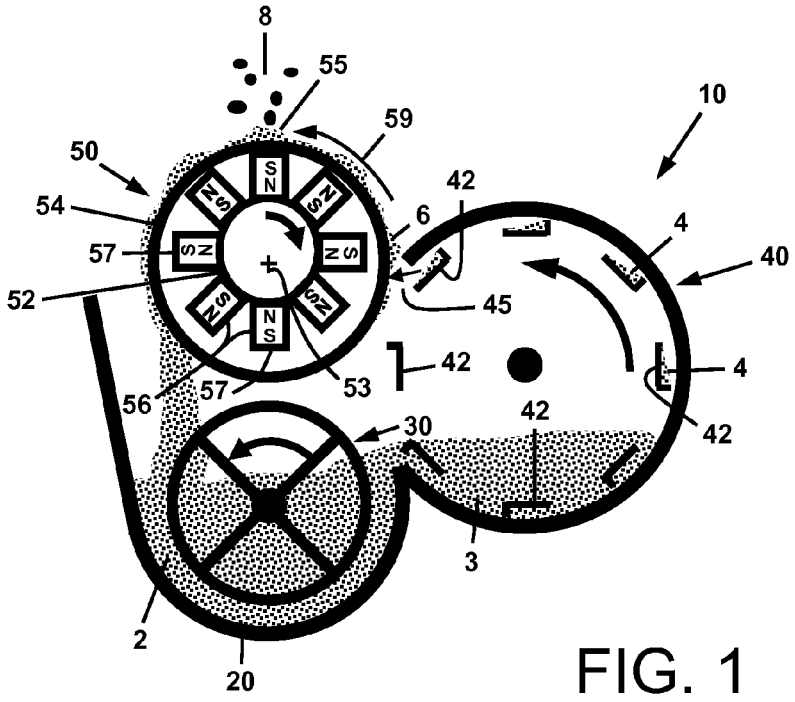
FIG. 1 is a schematic illustration of a magnetic brush development system with mixture of powder and permanently magnetized beads.

The present invention will be described in connection with certain preferred embodiments. However, it is to be understood that there is no intent to limit the invention to the embodiments described. On the contrary, the intent is to cover all alternatives, modifications, and equivalents as may be included within the spirit and scope of the invention as defined by the appended claims.

DETAILED DESCRIPTION

For a general understanding of the present invention, reference is made to the drawings. In the drawings, like reference numerals have been used throughout to designate identical elements. It is to be understood that the overall scale of the drawings and the relative sizes of particular features are as shown for the sake of clarity of illustration, and may vary from that shown.

The inventions disclosed herein may be used for fabrication of a wide variety of devices and materials by using shaped slot electrode control of direct electrostatic powder deposition. To fully illustrate the process, a detailed description with certain preferred embodiments are provided. The deposition process of the invention involves an advantageous configuration between the elements of a charged powder source, shaped slot electrode(s) and a powder deposition substrate.

In certain embodiments, the charged powder source may be provided by a magnetic brush development system as widely used in electrophotography for powder charging and transport to a deposition zone. One preferable magnetic brush development system utilizes a mixture of the deposition powder and permanently magnetized carrier beads as disclosed in U.S. Pat. No. 4,546,060, the disclosure of which is incorporated herein by reference. The magnetic carrier particles comprise a magnetic material exhibiting hard magnetic properties as characterized by a coercivity of at least 300 gauss and exhibit an induced magnetic moment of at least 20 emu/g when in an applied field of 1000 gauss.

FIG. 1 is a schematic illustration of such a magnetic brush development system 10 comprised of a sump 20, a cross mixer 30, a paddle wheel elevator 40, and a magnetic brush roll assembly 50. The system 10 is configured to provide charged powder for transport and deposition on a substrate for the formation of objects, as will be described subsequently herein.

In the operation of system 10, the cross mixer 30 is rotated in the sump 20, which contains the mixture 2 of deposition powder and permanently magnetized carrier beads. The rotation of the cross mixer 30 in the mixture 2 provides mechanical energy to the mixture 2 for the purpose of triboelectrically charging the powder if it is insulating. The cross mixer 30 furthermore moves the mixture 2 from side to side in the sump to maintain a uniform level of the mixture in the sump, thereby resulting in a uniform transfer of powder across the powder deposition width on to a substrate as will be explained subsequently.

The paddle wheel elevator 40 receives a portion 3 of the mixture 2 from sump 20 by the action of cross mixer 30. Paddles 42 are fastened to a rotating drive (not shown) such that paddles 42 dip into the mixture 2, and capture samples 4 of the mixture 2. The samples 4 are conveyed to a metering zone 45 proximate to the magnetic brush roll assembly 50, which is comprised of a rotatable magnetic core 52 and an outer nonmagnetizable conductive shell 54 that is generally maintained at a grounded electrical bias. As a sample 4 passes into the metering zone 45, at least a portion 6 of the sample 4 is transferred onto the surface of the outer nonmagnetizable conductive shell 54.

The rotatable magnetic core 52 is offset (upwardly in FIG. 1) from the central axis 53 of the nonmagnetizable conductive shell 54 so that the portions 6 of the mixture can be released to the cross mixing sump 20 after the portions pass through a powder cloud generation zone 55. Magnets 56 of the rotatable magnetic core 52 attract the portions 6 of the mixture through the metering zone 45 to the surface of the nonmagnetizable conductive shell 54 and form bristles of mixture (not shown) in the proximity of each magnetic pole 57. Rotation of the magnetic core 52 in the clockwise direction causes the portions 6 of the mixture to tumble and transport in the counter-clockwise direction as indicated by arrow 59.

Along any circumferential location on the surface of the outer nonmagnetizable conductive shell 54, the magnetic field oscillates due to the circular trajectories of the magnetic poles 57 that result from rotation of the rotatable magnetic core 52. The magnetic field oscillations caused by the rapid circular motions of the magnetic poles 57 cause the portions 6 of the mixture that are on the surface of the outer nonmagnetizable conductive shell 54 to move vigorously in a wave motion having crests and troughs.

Furthermore, the vigorous mechanical energy supplied to the mixture causes the generation of a cloud 8 of charged powder proximate to the surface of the nonmagnetizable conductive shell 54. The powder cloud 8 forms when powder from the portions 6 of the mixture is separated from the permanently magnetized carrier beads, which are retained on the nonmagnetizable shell conductive 54 by the magnetic field from the rotatable magnetic core 52. When such powder is in a cloud 8, relatively weak electric fields can be used to cause motion of the powder away from the nonmagnetizable conductive shell 54. In contrast, if no means of forming a charged powder cloud were present, and the charged powder simply resided on the surface of the nonmagnetizable conductive shell 54, much higher electric fields would be required to detach the powder particles for subsequent transport away from the nonmagnetizable conductive shell 54.

The magnetic bead particles used in the mixture 2 may be either insulating, semiconducting or conducting. Polymeric coatings may be applied to the core bead material to control the triboelectric charging properties of the coated beads when mixed with insulative powder. Examples of core bead materials include gamma ferric oxide, barium ferrite and strontium ferrite. In certain embodiments, the average diameter of the magnetic beads may be in the range of 10 to 200 micrometers (μm). In other embodiments, the average diameter of the magnetic beads may be in the range of 20 to 1000 μm. In certain embodiments, the mixture of powder and magnetic carrier beads is comprised of at least about 60 weight percent of magnetic bead particles.

The powder used in the mixture 2 may also be insulating but charge relaxable such that the powder tends to be insulating during the process of triboelectric charging in the magnetic brush system 10 and deposition of powder from the cloud 8 onto the substrate, but upon sufficient dwell time on the substrate and/or subjecting the powder to an ambient such as moisture, the charge on the deposited powder relaxes (dissipates). Examples of insulative and charge relaxable powders include various polymeric materials, mixtures of such materials with pigments or dyes, ceramic powders, charge relaxable coatings on polymeric and ceramic powders, etc. Blends of such powders may also be used in the magnetic brush deposition system 10. In certain embodiments, the preferred charge relaxable powder may have a relaxation time in the range of about 100 milliseconds. As used herein, the term "relaxation time in reference to charged powders is the amount of time required for charge on the powder to decrease to a fraction of 1/e, or 0.37 since e=2.72.

Alternative configurations commonly used in the reprographics industry may also be used in place of the system 10 described above. Non-contact systems such as single component development systems with AC biased rolls or wire electrodes and others may be used.

The Applicants have discovered that by providing certain configurations of shaped slot electrodes and using either insulating or charge relaxable powders, repeated sequential depositions of such powders from a magnetic brush deposition system 10 may be made onto a substrate to repeatedly build a three-dimensional object with spatially varying material properties. This is best understood with reference to FIGS. 2-11.

Figure 2:
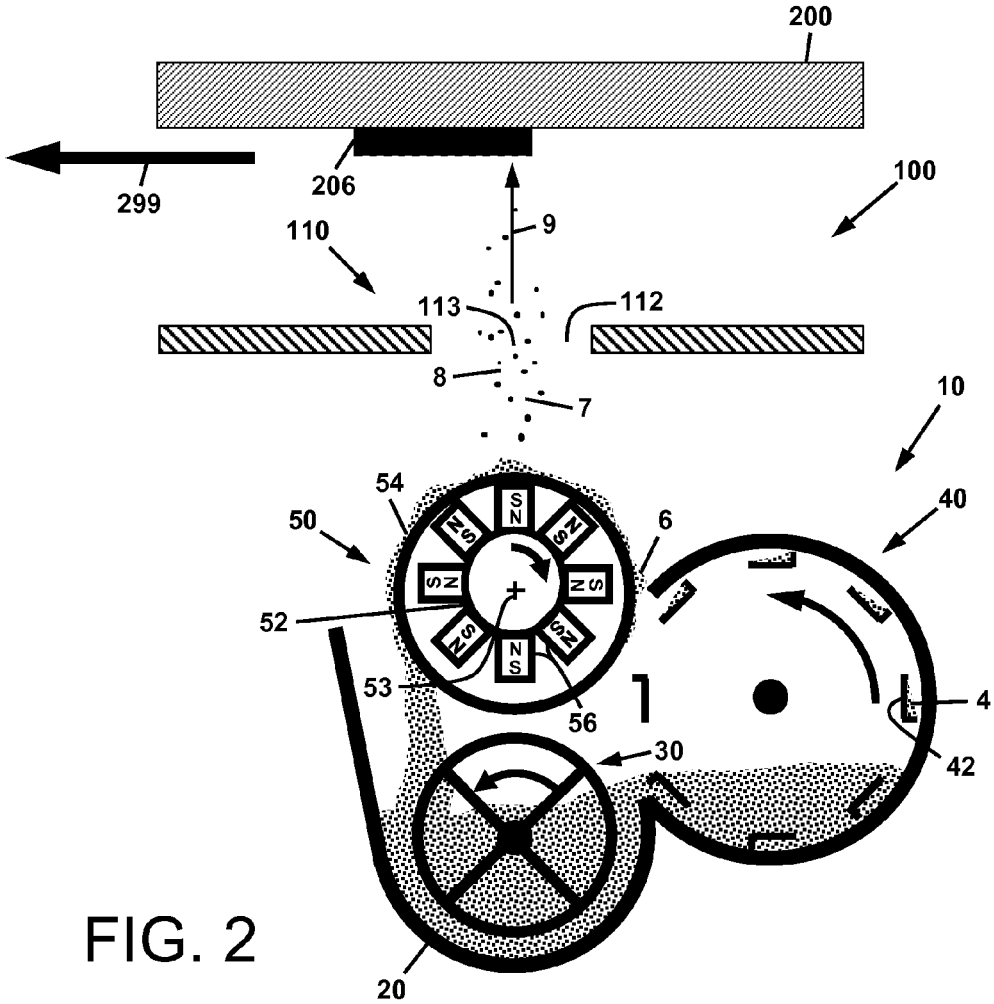
FIG. 2 is a schematic illustration of powder deposition onto a moving substrate with stationary slot shaped electrode.

Referring first to FIG. 2, one configuration of a powder deposition system 100 is shown in which a slot shaped electrode 110 is positioned between a powder cloud source 8 from a magnetic brush powder deposition system 10 and a biased substrate 200. In this configuration, the control electrode 110 is stationary relative to the magnetic brush system 10. The electrical bias provided by a voltage source (not shown) on the electrode 110 relative to the nonmagnetizable shell 54 may be varied to control the passage of charged powder 8 through the slot 112.

The substrate 200 may be electrically conductive. The conductivity of the substrate may result from bulk conductivity of the substrate, or alternatively, the substrate may be comprised of a conductive backing electrode layer (not shown) on a surface thereof. In certain embodiments, the conductivity of the substrate or its backing electrode layer may be of at least about $10^{-8}$ Siemens per meter. In certain embodiments, the conductive backing electrode layer may further include an insulating or charge-relaxable overcoating (not shown). In such a substrate configuration, the charged powder is deposited on the insulating/charge-relaxable overcoating side of the substrate.

If the substrate 200 is electrically conductive, or if the substrate is insulative but has a conductive backing electrode, the substrate electrical bias voltage is of such polarity and magnitude to electrostatically attract the charged powder 8 towards the substrate 200 as indicated by arrow 9. The electrical bias on the substrate 200 provides a weak fringe electric field that extends into the slot 112 in the region 7 between the powder source and the slot electrode 110. In the absence of an electric field from an electrical bias voltage on the slot shaped control electrode 110 relative to a ground potential on shell 54, powder in the cloud 8 that is proximate to the magnetic brush powder system 10 is electrostatically attracted by the electrical bias on the substrate 200 and focused in the central area 113 of the slot electrode 110 to cause deposition or powder onto the substrate 200. If the biased substrate 200 is stationary, the width of the deposited powder 206 is less than the width of the slot 112.

If an electrical bias voltage with the same polarity as that of the charged powder 8 is applied to the slot shaped electrode 110, the rate for which the charged powder 8 passes through the slot 112 can be controlled with a relatively low range of electrical bias voltage. With increasing back bias, the width of the powder deposition 206 relative to the slot 112 also decreases, even to the point of no powder deposition on the substrate 200. In certain embodiments, the bias voltage of the same polarity as that of the charged powder may be between about zero to about 500 volts.

If the substrate 200 is moving during powder deposition as indicated by arrow 299, the amount of powder 206 (i.e., the powder mass per unit area) deposited on the substrate 200 can be controlled by varying the electrical bias on the slot shaped electrode 110 as a function of time. Other powder layers of the same or different powder material can be superimposed on top of or adjacent to previously deposited powder 206. In certain embodiments, this may be accomplished by providing additional development systems (not shown) and slot electrodes (not shown) positioned along the path of the moving substrate. In that manner, a 'shaped' layer of powder can be formed on the substrate. The thickness of the powder layer 206 that is deposited proximate to a particularly long uniform slot 112 is also uniform in the direction of the axis 53 of the rotatable nonmagnetizable shell 54, but may be varied in the direction of the motion 299 of the substrate 200 by varying the electrical bias on the slot shaped electrode 110. The substrate 200 may be substantially planar, and may be provided in the form of a web. A web substrate may be unwound from a first roll (not shown), passed by the system 100 to receive charged powder, optionally treated with a heat and/or pressure fuser system (not shown) to consolidate the received charged powder, and rewound on a second roll (not shown).

The capability to build thick powder layers with charged powder is facilitated with the use of charge relaxable powders. It should also be noted that although FIG. 2 shows movement in one process direction 299, the biased substrate can also be moved in the lateral direction (i.e., into or out of the plane of FIG. 2) as well. Accordingly, in an embodiment comprising an electrode (not shown) having a single circular hole instead of an elongated slot, a line of powder of any shape could be written on the substrate, with the substrate attached to a computer controlled stage (not shown) for movement in any direction. In certain embodiments, the slot 112 of the electrode 110 may have an elongated shape with a longitudinal axis perpendicular to the process direction 299.

The illustration of FIG. 2 depicts an electrode 110 comprising only a single slot 112. However, it is to be understood that a single electrode structure may have multiple slots of various shapes along the axis of the magnetic brush system 10. For the configuration of either a single or multiple slots in an electrode, the amount of powder deposition may also be controlled by varying the electrical bias on the substrate while maintaining a constant electrical bias on the slot(s) electrode that allows for the passage of charged powder 8. However, a configuration in which electrodes surrounding multiple shaped slots enable independent electrical bias control of charged powder deposition requires a constant electrical bias on the substrate.

Figure 3:
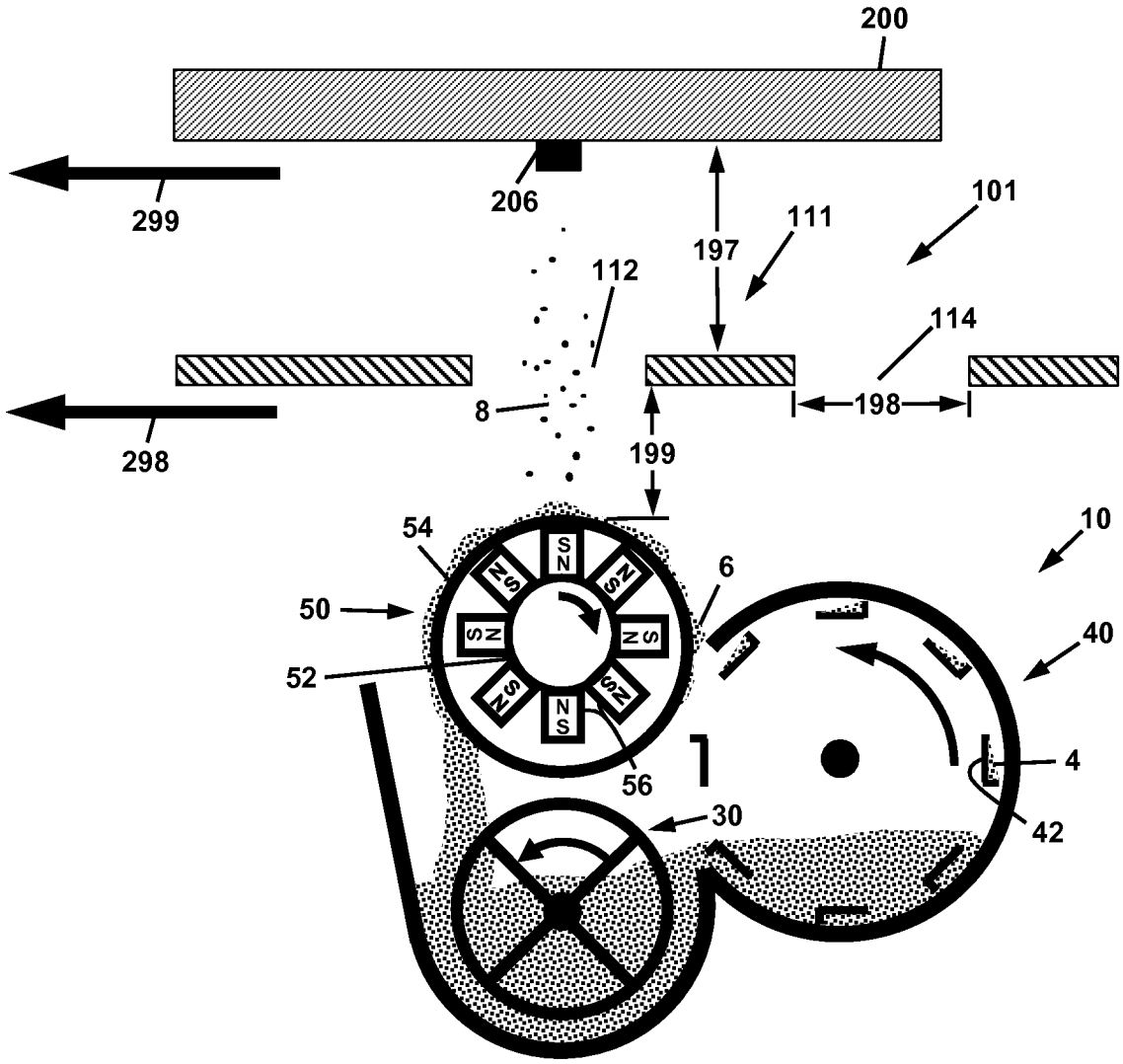
FIG. 3 is a schematic illustration of powder deposition onto a moving substrate with a synchronous moving slot shaped electrode (stencil)

Referring to FIG. 3, another configuration of a powder deposition system 101 is shown in which slot shaped electrode structure (stencil) 111 is stationary relative to the biased substrate 200. Although FIG. 3 depicts the electrode structure 111 and substrate 200 moving together (arrows 299 and 298) relative to the stationary magnetic brush system 10, in an alternative configuration (not shown), the electrode structure 111 and substrate 200 may be stationary while the magnetic brush system 10 is moving. Thus in general, the system 101 is operable with relative motion occurring between the magnetic brush system 10 and the substrate 200 and stencil electrode structure 111.

The stencil electrode 111 is comprised of a plurality of openings 112, 114, and others (not shown). The openings 112, 114, etc., may be of varying shape including but not limited to rectangular slots, squares, circles, and the like. (Hence the use of the term "stencil"). Operating the stencil electrode 111 with variable electrical bias enables a powder deposition pattern onto substrate 200 according to the shape of the openings 112, 114, etc. in the stencil. It is noted that the stencil electrode 111 is spaced from the substrate 200 such that multiple depositions may be performed with the same or different powders. Variable amounts of powder deposition on the moving substrate 200 in the process direction 298 may be obtained by controlling the electrical bias on the stencil electrode 111 or an array (not shown) of such electrodes.

In certain embodiments, the spacing 199 between the nonmagnetizable conductive shell 54 and the patterned electrode 111 may be between about 0.5 and about 2 centimeters (cm). In certain embodiments, the width 198 of the slots in the patterned electrode 111 in the process direction may be between about 0.2 to about 2 cm. In certain embodiments, the spacing 197 between the patterned electrode 111 and the substrate 200 may be between about 0.5 and about 3 cm. In certain embodiments, the bias voltage of the substrate 200 is of opposite polarity to that of the charged powder, and may be in the range of 0 to 5000 volts. In certain embodiments, the bias voltage of the patterned electrode 111 is of the same polarity as that of the charged powder, and may be between about zero to about 500 volts. The flow of powder 8 to the substrate 200 may be controlled by varying the electrical bias on either the substrate 200 or the patterned electrode 111 as a function of time. The above range of parameters described in connection with system 101 in FIG. 3 are also applicable to system 100 shown in FIG. 2.

Figure 4:
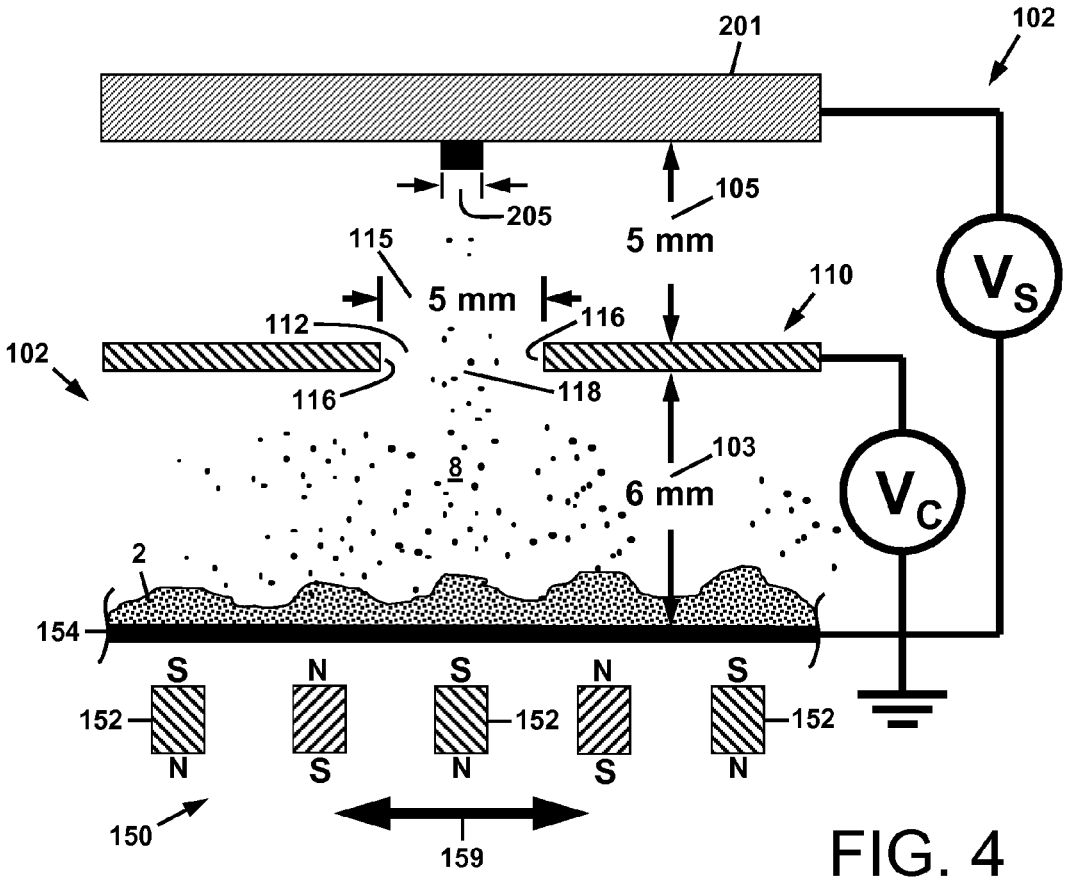
FIG. 4 is a schematic illustration of an alternative powder deposition apparatus with a stationary slot shaped electrode and stationary biased conductive substrate.

FIG. 4 is a schematic illustration of an alternative powder deposition apparatus for charged powder deposition with a slot shaped electrode and stationary biased conductive substrate. In FIG. 4, exemplary parameters are provided for spacings from and voltages applied to the slot electrode 110. It is to be understood that such parameters are meant to be illustrative of one embodiment of the instant powder deposition method and apparatus, and are not limiting.

As an alternative to the magnetic brush powder deposition systems 100 and 101 of FIGS. 2 and 3, a powder deposition system 102 is illustrated in FIG. 4. The system 102 is comprised of a linear array 150 of permanent magnets 152 that are mounted on a fixture (not shown). The fixture is operatively coupled to driving means (not shown) that is configured to drive oscillating motion of the magnets 152 as indicated by bidirectional arrow 159. The array of magnets 150 is positioned under a nonmagnetic conductive (grounded) tray 154 containing a mixture 2 of charged powder and permanently magnetized beads. The oscillating magnets 152 agitate the mixture 2 in a manner similar to that described previously for a magnetic brush system, such as system 10 of FIGS. 2 and 3.

The system 102 is further comprised of a uniformly wide slot in electrode 110 connected to an electrical power supply that provides an electrical bias voltage of $V_c$ to the electrode 110. In certain embodiments, the slot 112 of the electrode may have a width 115 of 5 millimeters (mm). The slot electrode 110 may have a spacing 103 of 6 mm from the tray 154 of powder mixture 2. The slot electrode 110 may have a spacing 105 of 5 mm from the substrate 201, which is electrically biased at a voltage of $V_s$. In certain embodiments, the substrate 201 may be conductive. In one embodiment, the substrate 201 is made of stainless steel.

The powder mixture 2 is comprised of powder that has been mixed with permanently magnetized beads. In certain embodiments, the average particle diameter of the powder is 12 μm, and the average particle diameter of the beads is 40 μm. The powder concentration of the mixture 2 may be 8% by weight. In one demonstration of the deposition system 102, the mixture 2 of powder and beads was tumbled in a rotating jar to triboelectrically charge the powder to a charge-to-mass ratio of +18 μC/g.

Figure 5:
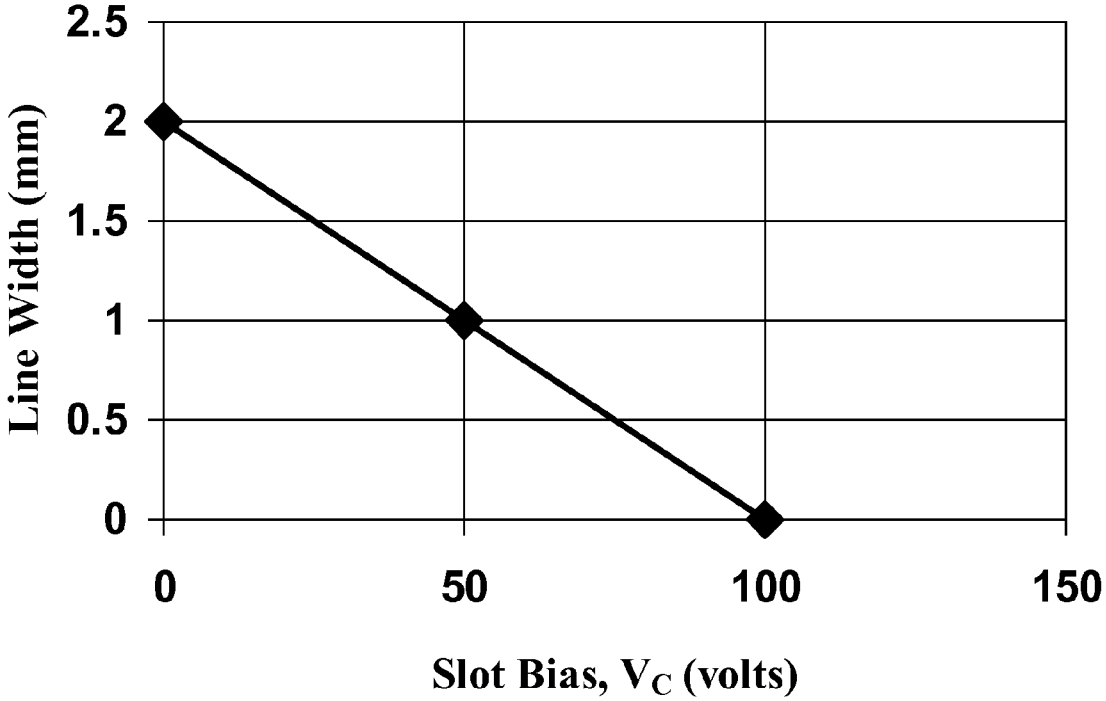
FIG. 5 is a graph of line width of powder deposition as a function of the slot shaped electrode bias for a stationary substrate.

FIG. 5 shows a plot of the line width 205 of deposited powder as a function of the slot bias voltage $V_c$ for operation of the system 102 when the electrical bias voltage on the substrate, $V_s$, was −1550 volts. The negative polarity provides an attractive electrostatic force acting on the positively charged powder 8. For $V_c$=0, the width 205 of the line of deposited powder was only 2 mm, as compared to the slot width 115 of 5 mm. Without wishing to be bound to any particular theory, the Applicants believe that the smaller width 205 of the deposited powder is due to a fringe electric field in the peripheral regions 116 of the slot 112, which focuses the charged powder 8 in the central region 118 of slot 112. For a $V_c$ electrical bias of only 100 volts, no deposition of powder was observed on the substrate. Thus it was demonstrated that a relatively low bias voltage $V_c$ and correspondingly low controlling electric field is effective in controlling the passage of charged powder through slot shaped electrodes for deposition onto a substrate.

Figure 6B:
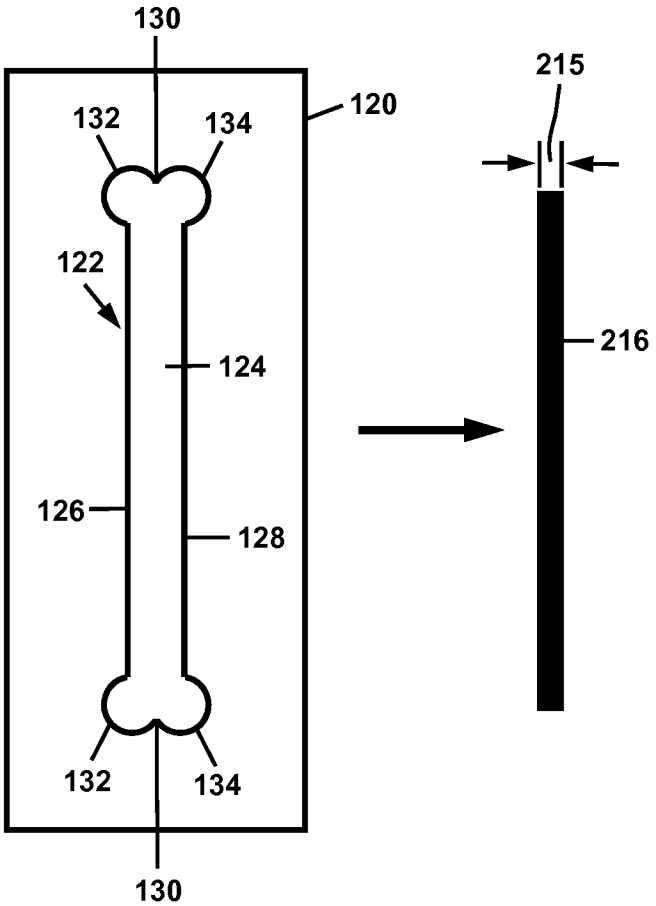
FIG. 6B is an illustration of line shape of powder deposition resulting from an alternatively shaped slot electrode positioned proximate to a stationary substrate.
Figure 6A:
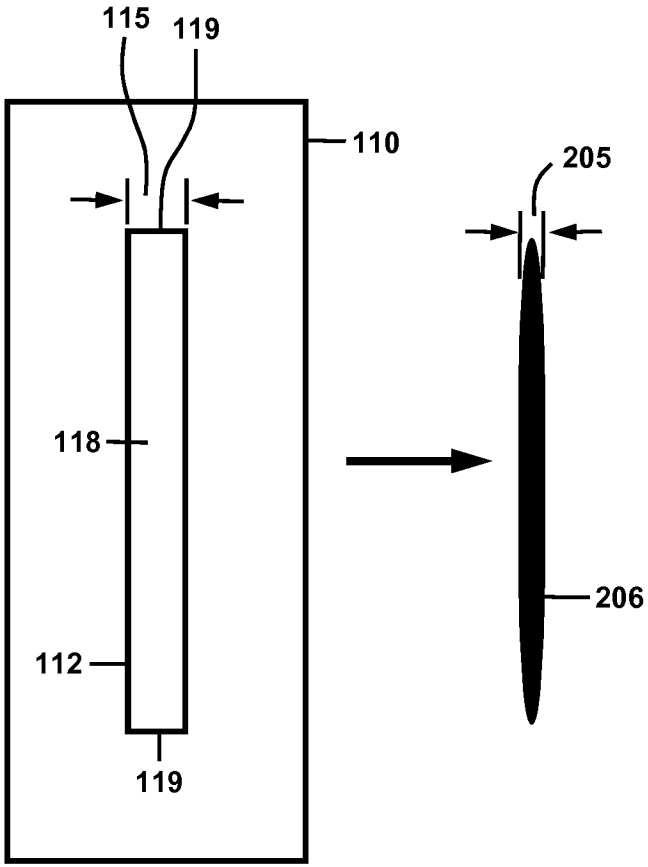
FIG. 6A is an illustration of line shape of powder deposition resulting from a rectangular shaped slot electrode positioned proximate to a stationary substrate.

FIG. 6A is an illustration of line shape of a powder deposition resulting from a rectangular shaped slot electrode positioned proximate to a stationary substrate, and FIG. 6B is an illustration of line shape of a powder deposition resulting from an alternatively shaped slot electrode positioned proximate to a stationary substrate. In FIGS. 6A and 6B, the respective substrates upon which the powder is deposited are not shown. Referring first to FIG. 6A, it can be seen that the width 205 of the deposition 206 is less that the width 115 of the slot 112 (see also FIG. 4) in the central region 118. Additionally, near the opposed ends 119 of the slot 112, the width 205 of the deposition tapers to a lesser width, becoming "cigar shaped," i.e. having the shape of an ellipse with a high aspect ratio.

In contrast, the Applicants have discovered that by altering the rectangular slot 112 of electrode 110, the shape of the powder deposition can be made to approximate a rectangle. Referring to FIG. 6B, in the embodiment depicted therein, an electrode 120 is provided having a slot 122 that is comprised of a central section 124 having opposed parallel edges 126 and 128, and opposed modified ends 130. The modified ends are comprised of adjacent arcuate sectors 132 and 134, which are intersected by opposed parallel edges 126 and 128, respectively. The slot 122 may thus be characterized as having a "dog bone" shape. The width 215 of a deposition 216 through slot 122 of electrode 120 has been found to be substantially constant, i.e., the deposition 216 onto the substrate (not shown) is rectangular shaped. Thus it is demonstrated that the end shape of a slot of an electrode may be configured to provide a well-defined powder deposition at the end of the slot as well as along its central region. Advantageously, the capability of obtaining well-defined deposition ends enables the fabrication of higher quality devices and materials when using multiple depositions of the same or different powders.

Figure 7:
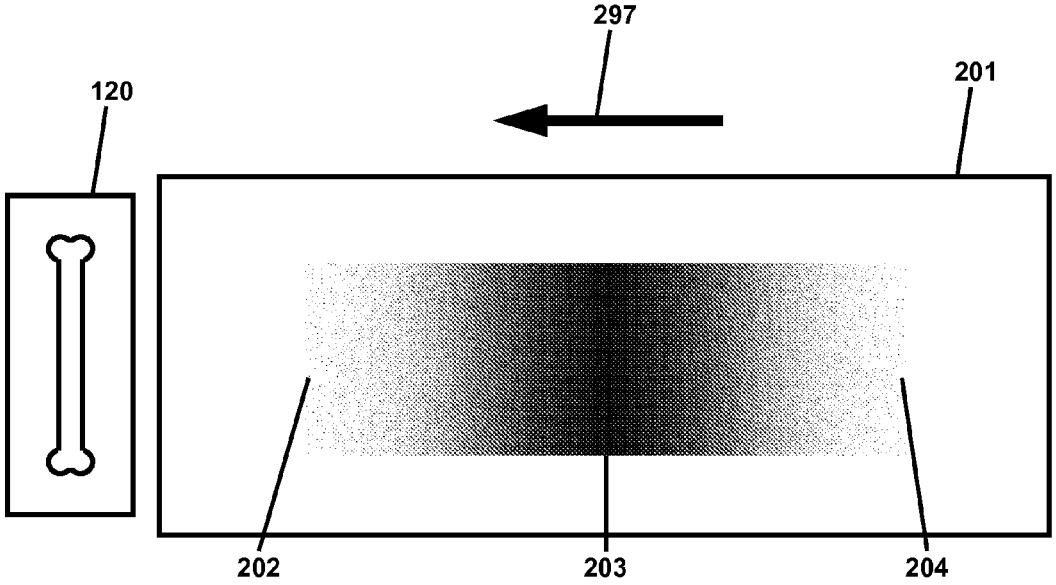
FIG. 7 is an illustration of variable powder deposition via stationary shaped electrode bias control during substrate translation to obtain a desired powder deposition profile.

FIG. 7 is an illustration of variable powder deposition via stationary shaped electrode bias control during substrate translation to obtain a desired powder deposition profile. In the embodiment depicted in FIG. 7, the "dog bone" shaped slotted electrode 120 of FIG. 6B is used to control the powder deposited on a moving substrate. The electrode 120 may be configured in a system such as shown in the deposition system 100 of FIG. 2, or other deposition systems having other charged powder cloud generating devices.

As the biased substrate 201 is translated at a uniform speed past the stationary slotted electrode 120 as indicated by arrow 297, the electrical bias voltage is varied on the electrode 120 in order to provide a desired amount of powder deposition on the substrate in the process direction 297. In FIG. 7, the relative amount of powder deposited is shown by a density gradient. To the left of region 202 of the substrate 201, the bias voltage is maintained sufficiently high to prevent deposition of powder. Then the bias voltage is gradually decreased to a minimum at region 203, resulting in a maximum amount of powder deposited; and the bias voltage is then increased up to region 204 to a level which again prevents the deposition of powder.

In certain embodiments, multiple devices may be simultaneously produced from multiple depositions through the use of multiple "dog bone" shaped slots arrayed above the magnetic brush powder deposition system perpendicular to the process direction. Additionally, the speed of translation of the substrate may also be varied in order to control the thickness of powder deposition on the substrate.

Figure 8:
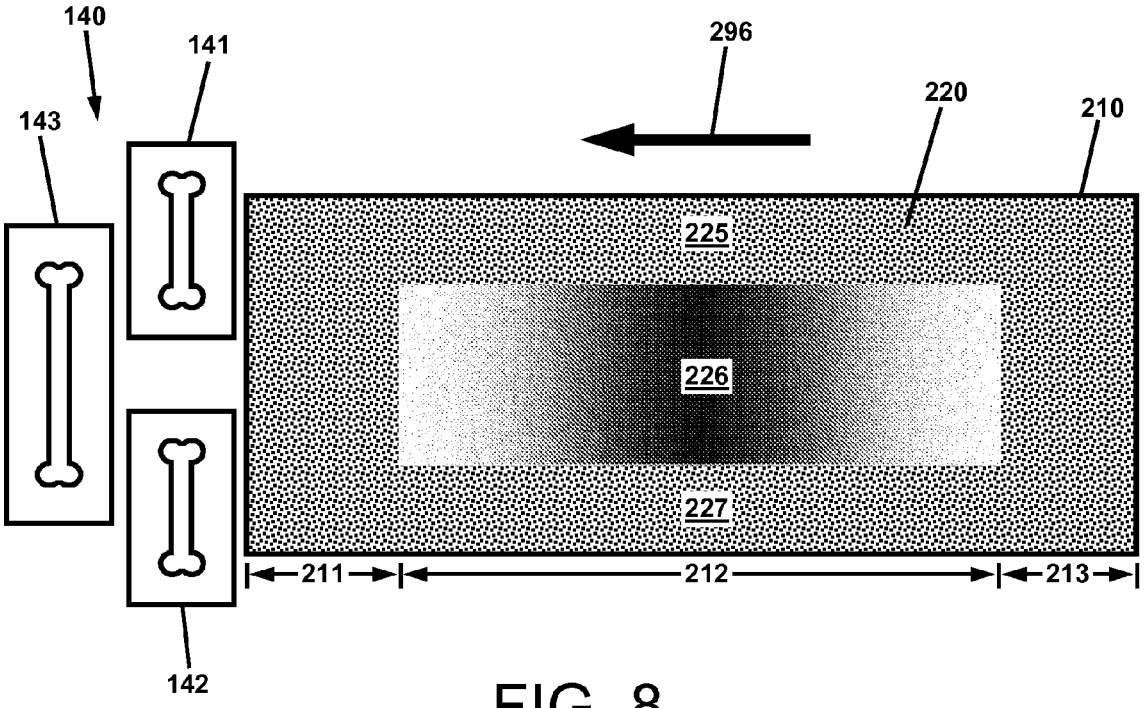
FIG. 8 is an illustration of multiple slot electrodes arranged perpendicular to the direction of the powder deposition process, which may be used to deposit multiple powders onto a substrate.

Shaped slotted electrodes of an alternative embodiment of a powder deposition system from which two powders are deposited onto a moving substrate is depicted in FIG. 8. The slotted electrodes 140 may be used with powder cloud generating devices shown in the deposition system 100 of FIG. 2, or other deposition systems having other charged powder cloud generating devices. The slotted electrodes 140 are comprised of shaped slots as shown in FIG. 6B, which are arranged perpendicular to the direction of motion of the substrate indicated by arrow 296.

Shaped slot electrodes 141 and 142 in FIG. 8 are utilized with a first powder in the first deposition system such as system 100 in FIG. 2. The first deposition system comprised of shaped slot electrodes 141 and 142 is used to deposit a first powder on the substrate in the pattern of the outer longer regions of rectangle 220. The shaped slot electrode 143 is utilized for both the deposition of a first powder and a second powder in a second deposition system as depicted in FIG. 2. The first deposition system comprised of shaped slot electrode 143 is used to deposit the first powder on the substrate at the ends of rectangle 220. The second deposition system comprised of shaped slot electrode 143 is used to deposit a second powder on the substrate in the pattern of the inner rectangle 230. In the powder deposition systems (not shown), there is provided a first powder development device containing a mixture of the first powder and permanently magnetized carrier beads, and a second powder development device containing a mixture of the second powder and permanently magnetized carrier beads. Each of the first and second powder deposition devices is configured to be able to deposit powder across the entire width of the substrate 210. Various powder patterns of the first powder and the second powder may be deposited by the separate operation of shaped slot electrode segments 141-143 to produce three-dimensional objects on a substrate. To accomplish this, a bias voltage control system (not shown) is provided by which the voltages on the multiple shaped slot electrode slot segments 141-143 may be independently varied.

The powder pattern of FIG. 8 is a simple example of a powder pattern comprising first and second powders from first and second charged powder deposition systems. Shaped slot electrode segments 141 and 142 are configured to deposit the first powder from a first powder cloud generating system (not shown), and shaped slot electrode segment 143 is configured to deposit both the first powder and the second powder from a first and second powder cloud generating systems (not shown). The powder pattern on substrate 210 may be deposited in three steps as the substrate 210 is translated past different combinations of the shaped slot electrodes 140.

In a first step, the leading region 211, the central region 212, and the trailing region 213 of substrate 210 are translated past shaped slot electrode segments 141 and 142 in proximity to a first powder deposition device containing a first powder of desired properties. Electrodes 141 and 142 are operated at a low bias voltage such that the first powder is deposited on the substrate 210 in the outer portions 225 and 227 of substrate 210.

In a second step, the shaped slot electrodes 141 and 142 on the first powder deposition device are replaced with the shaped slot electrode 143. Prior to the beginning of the leading region 211, the shaped slot electrode 143 is maintained at a high bias so that powder is not deposited before the leading region 211. In the leading region 211, the electrode 143 is switched to a low bias to provide powder deposition while the leading region 211 is traversed past the shaped slot electrode 143. Then as the central region 212 is traversed past the shaped slot electrode 143, the bias on electrode 143 is maintained at a high bias to prevent the deposition of the first powder in the central portion 226 of the central region 212 of the substrate 210. Then as the trailing edge region 213 is traversed past the shaped slot electrode 143, the electrode 143 is switched back to a low bias to provide powder deposition. At the end of the trailing region 213, the electrode 143 is switched to a high bias to prevent powder deposition. Following the completion of steps one and two, the peripheral portion 220 on substrate 210 is coated with the first powder, while the central portion 226 remains uncoated.

In a third step, the electrode 143 is utilized in combination with the second powder in the second powder cloud generation system as shown in FIG. 2. Prior to the beginning of the leading region 211, the shaped slot electrode 143 is maintained at a high bias so that the second powder is not deposited before the leading region. As the region 211 is traversed past the shaped slot electrode 143, the electrode 143 continues to be maintained a high bias to prevent powder deposition. Then as the central region 212 is traversed past the shaped slot electrode 143, the central slotted electrode segment 143 is operated with the bias voltage being varied as described previously and shown in FIG. 7, i.e. from a high bias voltage to a low bias voltage, and back to a high bias voltage, resulting in an increasing powder thickness to a maximum, and back down to a minimum in the central portion 226. Then as the trailing edge region 213 is traversed past the shaped slot electrode 143, the electrode 143 is switched back to a low bias to provide powder deposition. At the end of the trailing region 213, the electrode 143 is maintained at a high bias to prevent powder deposition. Following the completion of steps one, two, and three, both peripheral portion 220 and central portion 226 on substrate 210 are coated with the first powder and second powder, respectively, as illustrated in FIG. 8.

By way of further explanation, the powder coating depicted in FIG. 8 was obtained in three steps using first and second powder in first and second charged powder cloud generating devices in combination with different electrode structures. Alternatively, the same powder deposition illustrated in FIG. 8 can be obtained by the use of three separate powder cloud generating devices, each with appropriate powder content and shaped slot electrodes. Furthermore, multiple passes of the substrate past powder cloud generating systems may be performed, such that similar powders can be superimposed on top of previously deposited powder in the same or different pattern as dictated by the shaped slot electrode and electrode voltage versus time profile. In general, different powders may be deposited by either replacing the mixture of powder and permanently magnetized beads in the sump or using multiple deposition units.

In order to complete the fabrication of a device or material, it may be necessary to subject the device/material to heat or heat under pressure. This heating may serve to ablate or burn away any polymer that was added to create a desired triboelectric charging property of the powder. Alternatively, each layer of powder may be transferred electrostatically from the substrate to another device so that the part is built up on this second device and the substrate only has one layer upon its surface at any given time. In this case, the powders may be caused to transfer and/or be consolidated (i.e. fused together) by heat and pressure on the substrate to which the layers are transferred.

FIGS. 9A-11 illustrate a powder deposition pattern in which two powders are deposited using a variable bias scheme to create a layer of constant total thickness. Over the length of the deposition, the thickness of the first powder increases continuously, while the thickness of the second layer decreases correspondingly.

Figure 9A:
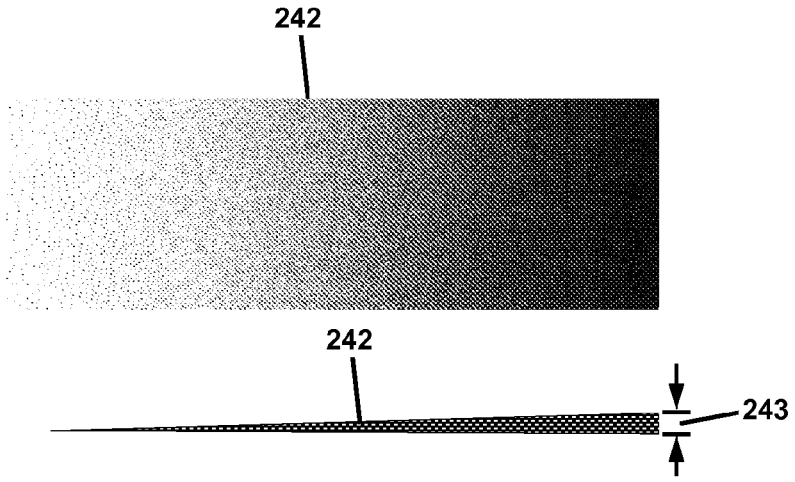
FIG. 9A is an illustration of linear powder deposition of type 1 powder in the direction of the powder deposition process when the voltage on a stationary slot electrode is varied linearly with time from a high to low bias as the substrate is moving at a constant speed.
Figure 9B:
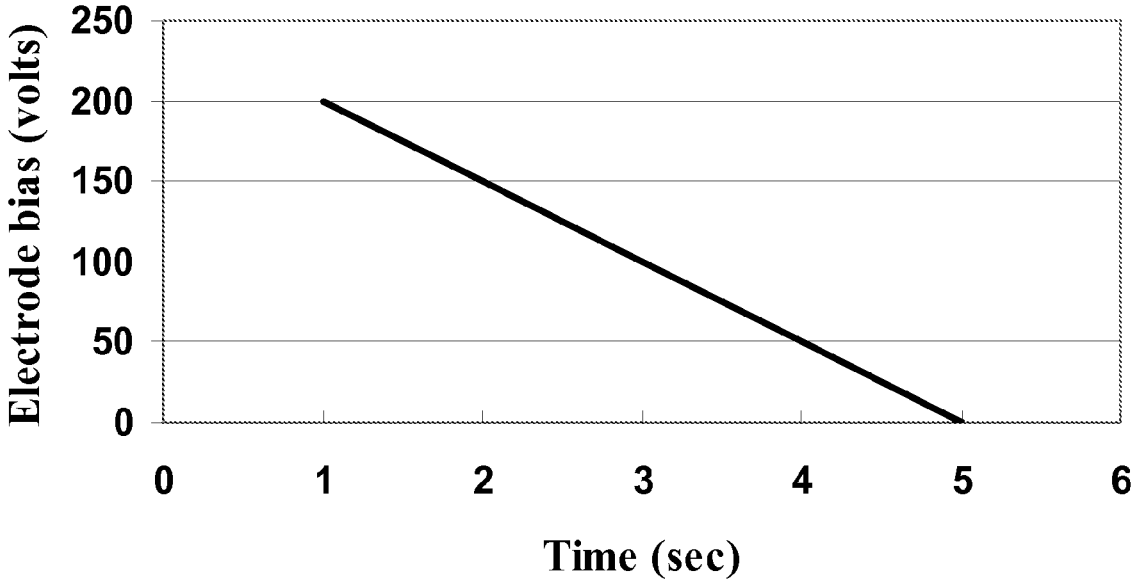
FIG. 9B is a graph of the voltage on the stationary slot electrode that is varied linearly from a high bias to a low bias, resulting in the powder deposition illustrated in FIG. 9A.

Referring first to FIG. 9A, a substrate (not shown) is translated past a first slot electrode (not shown) that is used to meter the deposition of a first powder 242 from a first charged powder deposition system by varying the bias voltage as described previously. For a positive charged powder, the positive bias voltage on the slot shaped electrode is decreased linearly as shown in FIG. 9B, resulting in a powder thickness increase from zero to a maximum thickness 243.

Figure 10A:
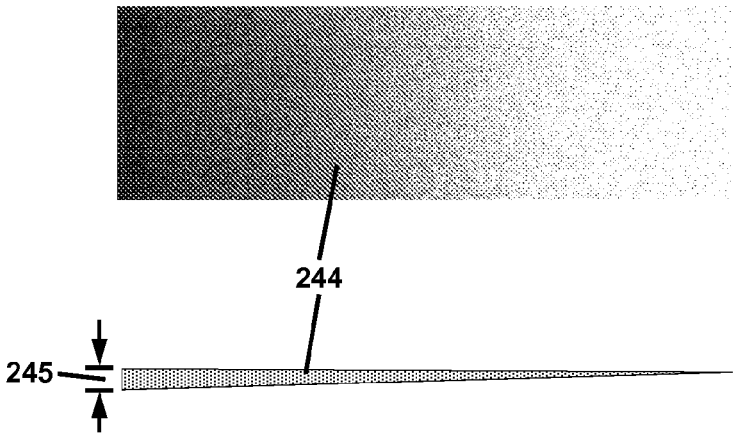
FIG. 10A is an illustration of linear powder deposition of type 2 powder in the direction of the powder deposition process when the voltage on a stationary slot electrode is varied linearly with time from a low to high bias as the substrate is moving at a constant speed.
Figure 10B:
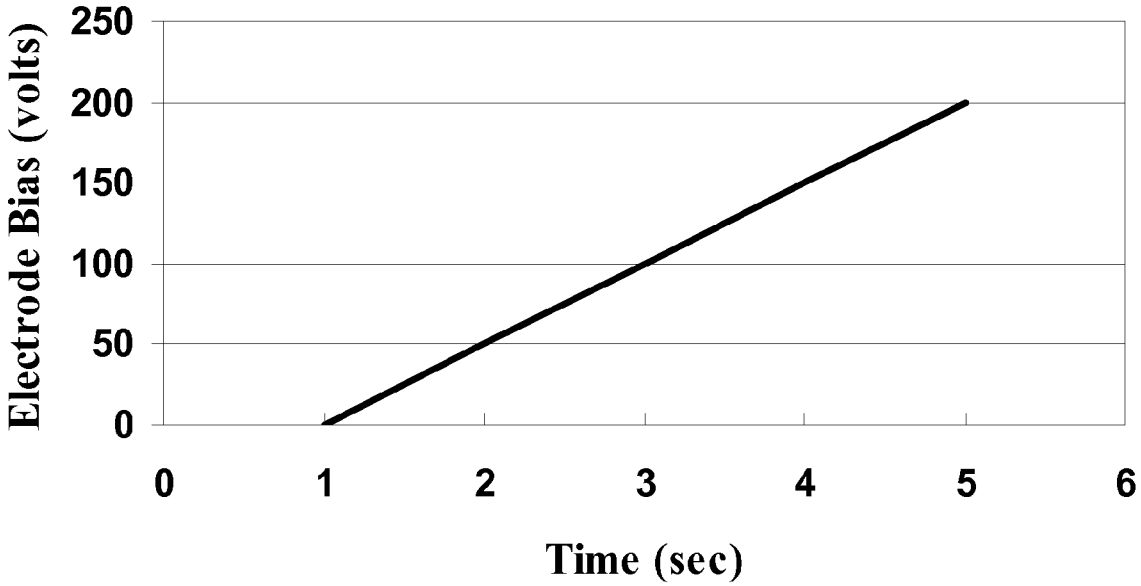
FIG. 10B is a graph of the voltage on the stationary slot electrode that is varied linearly from a low bias to a high bias, resulting in the powder deposition illustrated in FIG. 10A.

Referring now to FIG. 10A, the substrate (not shown) is translated past a second slot electrode (not shown) that is used to meter the deposition of a second powder 244 from a second charged powder deposition system by varying the bias voltage as described previously. For a positive charged powder, the positive bias voltage on the slot shaped electrode is increased linearly as shown in FIG. 10B, resulting in a powder thickness decrease from a maximum thickness 245 to a zero thickness.

Figure 11:
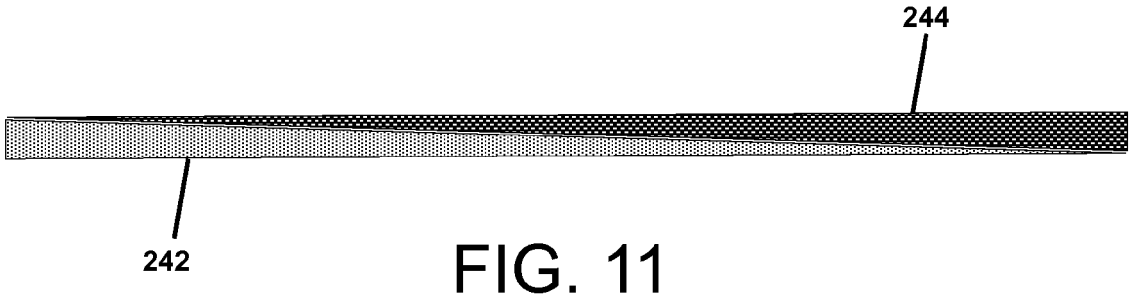
FIG. 11 is an illustration of the combined profiles of type 1 and type 2 deposited powders of FIGS. 9 and 10 to produce an overall uniform thickness.

The instant powder deposition system may be provided such that the powder patterns of FIGS. 9A and 10A may be deposited with the first powder 242 deposited on top of the second powder 244 as shown in FIG. 11, or vice-versa. It can be seen that the combined profiles of the first and second deposited powders 242 and 244 produce an overall uniform thickness of deposited powder.

In using the powder deposition systems disclosed herein, various patterns and devices may be created by varying the number of slotted electrodes, the number of powders, the number of slots in the electrodes and the bias voltage. The bias voltage on the slotted electrodes may be varied in a non-linear manner in order to create nonlinear thickness variations in the layers. The slotted electrodes may be either stationary relative to the powder source or moving with the substrate as a stencil. Two or more of the same or different powders may be deposited to create desirable combinations of layers and patterns using the powder deposition systems disclosed herein.

It is, therefore, apparent that there has been provided, in accordance with the present invention, a method and apparatus for fabricating two-dimensional and three-dimensional objects by charged powder deposition. Having thus described the basic concept of the invention, it will be rather apparent to those skilled in the art that the foregoing detailed disclosure is intended to be presented by way of example only, and is not limiting. Various alterations, improvements, and modifications will occur to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims.

We claim:

1. A method of fabricating an object, the method comprising:

a) causing the formation of a cloud of charged powder having single electrical polarity and proximate to an electrode comprising at least one shaped slot, the electrode disposed between the cloud and a conductive substrate positioned to receive a portion of the charged powder;

b) applying a first bias voltage of a polarity opposite the polarity of the charged powder to the conductive substrate to cause movement of a portion of the charged powder of the single electrical polarity from the cloud through the at least one shaped slot of the electrode to the substrate;

c) applying a second bias voltage of between zero and a non-zero voltage of the same single polarity as the charged powder to the electrode; and d) varying the magnitude of one of the first and second bias voltages, thereby causing variation in the rate of movement of the portion of the charged powder from the cloud through the at least one shaped slot to the substrate while forming a first part of the object on the substrate.

2. The method of claim 1, wherein the formation of the cloud of charged powder is caused proximate to a plurality of electrodes, each of the electrodes comprised of at least one shaped slot that can be independently electrically biased.

3. The method of claim 1, further comprising moving the substrate relative to the electrode.

4. The method of claim 3, wherein the at least one shaped slot of the electrode has a longitudinal axis perpendicular to the direction of relative motion of the substrate.

5. The method of claim 3, further comprising moving the substrate past the electrode at least two times, thereby depositing multiple portions of charged powder onto the substrate.

6. The method of claim 1, further comprising moving the electrode with the substrate.

7. The method of claim 1, further comprising causing the formation of a plurality of clouds of charged powder proximate to at least a first electrode and a second electrode, each of the electrodes disposed between the clouds and the conductive substrate.

8. The method of claim 7, wherein the plurality of clouds of charged powder are formed from a plurality of different powder materials.

9. The method of claim 8, wherein each of the electrodes is comprised of at least one shaped slot for controlling the flow of charged powder from at least one of the clouds of charged powder.

10. The method of claim 1, wherein the formation of the cloud of charged powder having the single electrical polarity is caused by a magnetic brush deposition system containing a mixture of magnetic carrier beads and triboelectrically charged powder.

11. The method of claim 10, further comprising causing the formation of a magnetic brush by a rotating magnetic field.

12. The method of claim 10, further comprising causing magnetic carrier beads to be permanently magnetized.

13. The method of claim 10, wherein the triboelectrically charged powder is insulating.

14. The method of claim 10, wherein the triboelectrically charged powder has a charge relaxation time of about 100 milliseconds.

15. The method of claim 10, wherein the mixture of powder and magnetic carrier beads is comprised of at least about 60 weight percent of magnetic carrier beads.

16. The method of claim 10, wherein the magnetic carrier beads have an average size of from about 20 micrometers to about 1000 micrometers.

17. The method of claim 1, wherein the conductive substrate is comprised of a conductive backing layer.

18. The method of claim 1, wherein the magnitude of the bias voltage applied to the electrode is varied to cause variation in the rate of movement of the portion of the charged powder from the cloud through the at least one shaped slot to the substrate.

19. The method of claim 1, wherein the powder is selected from insulative powders and charge relaxing powders, and combinations thereof.

20. The method of claim 1, wherein the at least one shaped slot of the electrode is an elongated slot having a longitudinal axis.

21. The method of claim 20, further comprising moving the substrate relative to the shaped slot electrode in a direction perpendicular to the longitudinal axis of the at least one shaped slot.

22. The method of claim 20, wherein the slot is comprised of a central section having opposed first and second parallel edges, a first end section comprised of first and second adjacent arcuate sectors intersected respectively by first ends of the first and second parallel edges, and third and fourth adjacent arcuate sectors intersected respectively by second ends of the first and second parallel edges.

* * * * *